US009877547B1

(12) United States Patent
Smith

(10) Patent No.: US 9,877,547 B1
(45) Date of Patent: Jan. 30, 2018

(54) DECORATIVE SHOE CLASP

(71) Applicant: Randall W. Smith, Lutz, FL (US)

(72) Inventor: Randall W. Smith, Lutz, FL (US)

(73) Assignee: Shoe Omnimedia, LLC, Lutz, FL (US)

( * ) Notice: Subject to any disclaimer, the term of this patent is extended or adjusted under 35 U.S.C. 154(b) by 0 days.

(21) Appl. No.: 15/671,343

(22) Filed: Aug. 8, 2017

(51) Int. Cl.

| | |
|---|---|
| ***A43B 23/24*** | (2006.01) |
| ***A44C 25/00*** | (2006.01) |
| ***A44C 15/00*** | (2006.01) |
| *A44C 13/00* | (2006.01) |
| *A44C 1/00* | (2006.01) |

(52) U.S. Cl.
CPC ..... *A43B 23/24* (2013.01); *A44C 15/0045* (2013.01); *A44C 25/007* (2013.01); *A44C 1/00* (2013.01); *A44C 13/00* (2013.01)

(58) Field of Classification Search
CPC ..... A43C 11/24; A43C 19/00; A43C 17/04; F16B 2/00; F16B 2/005; F16B 2/02; A47G 25/82; Y10T 24/3429; Y10T 24/3428; A43B 3/0078; A43B 23/24; G09F 3/04
USPC ..... 24/3.1, 3.11, 3.12; 63/14.4, 14.3, 14.5
See application file for complete search history.

(56) References Cited

U.S. PATENT DOCUMENTS

| | | | | |
|---|---|---|---|---|
| 2,078,293 | A * | 4/1937 | Smith, Jr. | A47G 25/82 24/328 |
| 2,763,999 | A * | 9/1956 | Norman | A44C 7/004 351/52 |
| 4,026,047 | A * | 5/1977 | Ahmer | A43B 3/0078 2/245 |
| 5,496,612 | A | 3/1996 | Ransbottom | |
| 6,412,151 | B1 | 7/2002 | Rowland | |
| 7,658,020 | B1 | 2/2010 | Yun | |
| 8,069,538 | B2 | 12/2011 | Wilcox | |

FOREIGN PATENT DOCUMENTS

| | | | | |
|---|---|---|---|---|
| GB | 2405571 | A * | 3/2005 | A43B 1/0036 |

* cited by examiner

*Primary Examiner* — Jack W Lavinder
(74) *Attorney, Agent, or Firm* — Michele L. Lawson; Smith & Hopen, P.A.

(57) ABSTRACT

A removeable shoe clasp for adding decorative ornaments to shoes is presented. The shoe clasp is comprised of an interior member connected to an exterior member by at least one hinge. The exterior member is attached to an attachment member onto which a decorative ornament may be removably attached. The shoe clasp allows for a wearer to easily add personalized elements to their shoes and to interchange the personalized elements among different shoes without damaging the shoe.

20 Claims, 4 Drawing Sheets

DECORATIVE SHOE CLASP

FIELD OF THE INVENTION

This invention relates to a novel removeable fastener. More particularly, it relates to a removeable shoe clasp having interchangeable connection hardware.

BACKGROUND OF THE INVENTION

Footwear is a multibillion dollar industry. Women, in particular, contribute to a large portion of footwear sales in the U.S. The ornamental appearance of footwear has always been an important reason for purchasing footwear and it has become increasingly popular for people to personalize their footwear with various shoe ornaments.

Decorative shoe ornaments have been known in the art for many years. However, current decorative shoe ornaments have several disadvantages including, but not limited to, ornamentation that damages the shoe in order for it to be attached to the shoe, stability of attachment to the shoe, limitation as to the position of the ornamentation on the shoe, limitations as to the type of shoe that can be adorned, etc.

U.S. Pat. No. 6,412,151 to Rowland discloses a shoe ornament locking clip apparatus which has a shoe ornament attached to a removeable locking clip that locks into a bar that is connected to the shoe at the time of manufacture. This apparatus has the disadvantage of having part of the apparatus installed in the shoe at the time of manufacture. This part of the apparatus, the bar, is not able to be removed from the shoe thus its original positioning is permanent. The bar not being able to be removed from the shoe means that even if there is no shoe ornament attached to it, the shoe would have a bar through it which many would find undesirable as it alters the appearance of the shoe permanently.

U.S. Pat. No. 8,069,538 to Wilcox discloses an apparatus for attaching ornaments to shoes, clothing, pet collars, etc. This apparatus features different interchangeable ornaments, however the apparatus consists of two parts that are connected via a twist-lock mechanism. In order for this apparatus to be used, there must be a hole or other opening in the article through which the two pieces attach or a hole must be created in the shoe thus permanently damaging the shoe. This is undesirable since many people would prefer their shoes not to be materially altered by placing a hole through a portion of the shoe.

U.S. Pat. No. 5,496,612 to Ransbottom discloses a shoe adornment that is in the form of a band that fits around the ball area of a human foot so that the ornament is positioned at the throat of the shoe. This apparatus has the disadvantage of not being placed on the shoe itself but rather is positioned around the foot of the wearer which can be uncomfortable.

U.S. Pat. No. 7,658,020 to Yun discloses a shoe ornament for a laced shoe. This apparatus is comprised of a buckle designed to receive a shoe lace therethrough allowing an ornament to be installed in the instep area of a shoe. While the apparatus can be transferred between different shoes, it has the disadvantage of being limited to use with shoes having laces.

As illustrated above, the prior art has several disadvantages when it comes to providing customizable removeable ornaments for shoes. These disadvantages include the need for specially manufactured shoes; the need to materially alter the shoes; the limitations as to the type of shoe that the ornament can be used on; the stability of the ornament on the shoe; and the limitations as to the placement of the ornament on the shoe. Accordingly, what is needed is a removable shoe clasp that does not materially permanently alter the shoe and can be stably attached to different locations on a number of different types of shoes.

SUMMARY OF INVENTION

A removable shoe clasp for attachment to shoes in order to personalize them with a decorative ornament is presented. The removable shoe clasp is generally comprised of an interior member hingedly attached to an exterior member which is connected to an attachment member. Interior member is curved to follow the curve of the interior surface of a shoe, depending on the desired positioning of the shoe clasp on the shoe. Exterior member and attachment member are curved to follow the curve of the exterior surface of a shoe, depending on the desired positioning of the shoe clasp on the shoe. The removeable shoe clasp presented herein allows for placement in various positions on a shoe and allows for placement on different shoes.

In an embodiment, a removeable apparatus for attaching a decorative ornament to a shoe is presented comprising: an interior member having proximal and distal ends wherein the distal end is wider than the proximal end; a curved exterior member having first and second ends and hingedly attached to the interior member at the first end by at least one hinge wherein the exterior member is curved to follow a curve of an exterior surface of the shoe; and a curved attachment member fixedly attached to the second end of the exterior member wherein the attachment member is curved to follow a curve of an exterior surface of the shoe. The proximal end of the interior member can be positioned over an edge of the shoe allowing the interior member to sit flush with an interior surface of the shoe and the exterior member to sit flush with an exterior surface of the shoe. The distal end of the interior member may be rounded. In some embodiments, the interior member may be comprised of a bottom portion and a top portion with the bottom portion being in the shape of a shoehorn. The top portion may be comprised of at least two elongate bodies. The interior member may be curved to follow a curve of an interior surface of the shoe. The at least one hinge may be a double locking hinge. In some embodiments, a pair of hinges are used.

A connecting bar may be positioned between the second end of the exterior member and the attachment member to connect the exterior member to the attachment member.

A non-slip cushioning material may be attached to at least one surface of the interior member and/or to the interior surface of the exterior member and the attachment member.

In another embodiment, a removable apparatus for attaching a decorative ornament to a shoe is presented comprising: an interior member comprised of a top portion having a proximal and a distal end wherein the proximal end of the top portion is comprised of two curved elongate bodies and a bottom portion having a proximal and a distal end wherein the distal end of the bottom portion is wider than the proximal end of the bottom portion; a curved exterior member attached to the two curved elongate bodies by a pair of hinges wherein the exterior member is curved to follow a curve of an exterior surface of the shoe; and a curved attachment member attached to the exterior member wherein the attachment member is curved to follow a curve of an exterior surface of the shoe. The two elongate bodies of the interior member can be positioned over an edge of the shoe allowing the interior member to sit flush with an interior surface of the shoe and the exterior member to sit flush with an exterior surface of the shoe. The distal end of the bottom portion of the interior member can be rounded. The pair of hinges can be double locking hinges.

A non-slip cushioning material may be attached to at least one surface of the interior member and/or to the interior surface of the exterior member and the attachment member.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Figure 1:
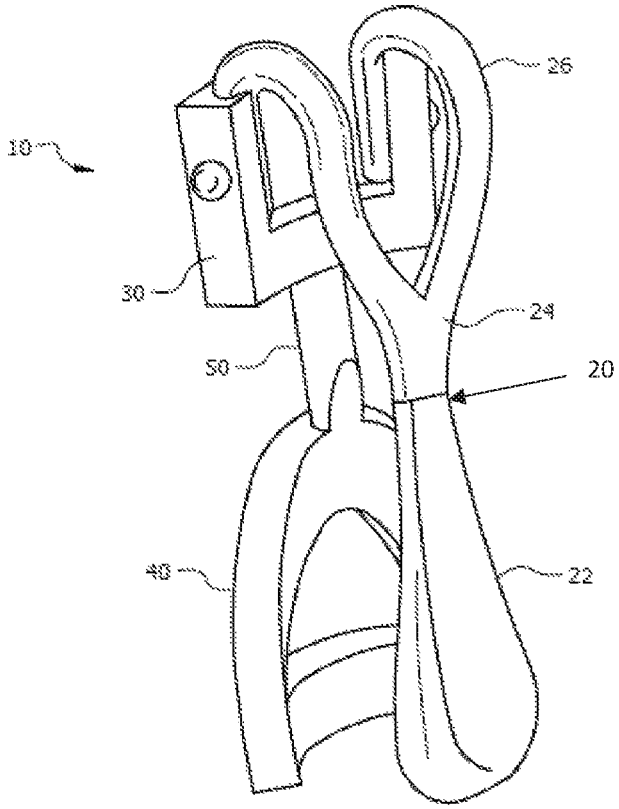
FIG. 1 is a perspective view of the shoe clasp in a closed position.

In the following detailed description of the preferred embodiments, reference is made to the accompanying drawings, which form a part hereof, and within which are shown by way of illustration specific embodiments by which the invention may be practiced. It is to be understood that there are other embodiments by which the invention may be practiced. It is to be understood that other embodiments may be utilized and structural changes may be made without departing from the scope of the invention.

Definitions

As used in the specification and claims, the singular form "a", "an" and "the" include plural references unless the context clearly dictates otherwise.

"Attachment member" as used herein refers to a part of the clasp which is positioned adjacent to the exterior member on the exterior of the shoe and is used to attach a decorative ornament to the shoe. In some instances, the attachment member is positioned adjacent to and below the exterior member. "Below" refers to positioning in the direction of the bottom sole of the shoe. In the drawings, the attachment member is shown to have a triangular shape, however the attachment member can take on any shape and size as long as it is capable of holding a decorative ornament securely to the shoe clasp and thus the shoe via the shoe clasp. The attachment member is formed so as to follow the natural curve of the portion of the shoe in which it is placed. For example, in the instance where the clasp is positioned at the rear of the shoe near the wearer's heel, the attachment member takes on a curved shape having concave and convex portions with the concave portion of the attachment member being adjacent to the back of the shoe and the convex portion of the attachment member facing outwardly from the back of the shoe to allow placement of a decorative ornament on the attachment member. In an embodiment where the clasp is positioned at the toe portion of the shoe near the wearer's toes, the curved shape of the attachment member follows the curved shape of the toe portion of the shoe so that the convex portion of the attachment member is positioned upwardly from the shoe to allow placement of a decorative ornament and the concave portion is positioned to be adjacent to the material of the toe portion of the shoe.

"Interior member" as used herein refers to the part of the clasp which is positioned in the interior of the shoe during use. The interior member is positioned between the wearer's foot and the interior of the shoe during use. The interior member consists of a body divided into a top and a bottom portion each having proximal and distal ends. In some embodiments, the bottom portion of the interior member is formed in the general shape of an elongated bar having proximal and distal ends with the distal end being greater in width than the proximal end. The elongated bar is curved along its longitudinal axis from proximal to distal ends to follow the natural curve of the shoe. In the example of the clasp being positioned at the rear of the shoe, the curved elongated bar is positioned so that the concave portion is adjacent to a wearer's heel when in use and the convex portion is in contact with the rear portion of the shoe when in use. In some embodiments, the bottom portion of the interior member can be in the general shape of a shoehorn with a curved body. In some embodiments, the distal end of the bottom portion of the interior member is rounded. The proximal end of the bottom portion of the interior member bifurcates to form the two separate elongate bodies of the upper portion of the interior member. The proximal ends of each of the elongate bodies curves over the edge of the shoe to attach to the hinge.

"Exterior member" as used herein refers to the part of the clasp which is positioned on the exterior of the shoe during use. The exterior member is formed so as to follow the natural curve of the portion of the shoe in which it is placed. For example, in the instance where the clasp is positioned at the rear of the shoe near the wearer's heel, the exterior member takes on a curved shape having concave and convex portions with the concave portion of the exterior member being adjacent to the back of the shoe and the convex portion of the exterior member facing outwardly from the back of the shoe. In an embodiment where the clasp is positioned at the toe portion of the shoe near the wearer's toes, the curved shape of the exterior member follows the curved shape of the toe portion of the shoe so that the convex portion of the exterior member is positioned upwardly from the shoe and the concave portion is positioned to be adjacent to the material of the toe portion of the shoe. In the drawings, the exterior member is shown as being substantially rectangular with an open top. This is an exemplary configuration. Any shape and size is contemplated as long as the exterior member is formed to hold hinge for connecting interior member to exterior member.

"Connecting bar" as used herein refers to a bar used to attach the exterior member to the attachment member in some embodiments. Not all embodiments will employ the connecting bar. In some embodiments, the attachment member will be directly attached to the exterior member so that no connection bar would be needed.

"Hinge" as used herein refers to a joint that attaches two things together, in this case attaching the exterior member to the interior member, while allowing for limited movement of 180° or less. In some embodiments, the hinge is a double locking hinge which allows for locking in two different positions. In some embodiments, there are grooves which allow for locking in multiple positions.

"Clasp" as used herein refers to a device for attaching an ornamental decoration to a shoe. In some embodiments, the clasp is made of a strong lightweight metal or metal alloy, including but not limited to, silver, sterling silver, gold, nickel, copper, tin, titanium, stainless steel, platinum, iron, zinc, aluminum, and electrum. Metal alloys mix two or more metallic elements in order to impart strength or corrosion resistance. Materials other than metals or metal alloys may be used for formation of the clasp including, but not limited to, plastics.

"Decorative ornament or adornment" as used herein refers to any attractive or distinctive object capable of being fixedly or removably attached to the attachment member.

"Shoe" as used herein refers to any article of footwear used to protect and comfort a wearer's foot. The term "shoe" includes, but is not limited to, sandals, boots, athletic footwear with or without laces, sneakers, heeled footwear, flat footwear, dress footwear, casual footwear, and slippers.

The present invention provides a removeable shoe clasp that can be adorned with at least one decorative ornament to personalize a wearer's shoes. The removeable shoe clasp is able to be used on multiple different types of shoes and able to be moved from one shoe to another with ease. The device is generally comprised of an interior member hingedly attached to an exterior member having an attachment member for attaching at least one decorative ornament.

Figure 2:
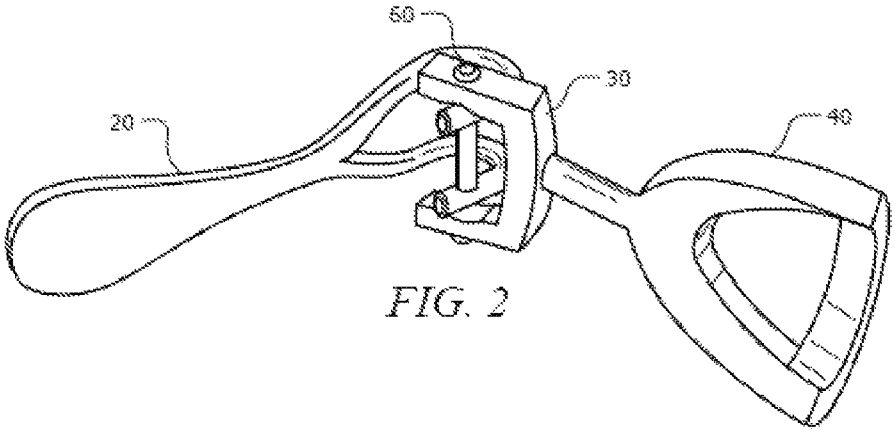
FIG. 2 is a perspective view of the shoe clasp in an open position.

FIG. 1 depicts shoe clasp 10 in a closed position. As shown in FIGS. 1 and 2, shoe clasp 10 is comprised of interior member 20 attached to exterior member 30 which is attached to attachment member 40 via connecting bar 50. As shown in the Figures, interior member 20 is comprised of bottom portion 22 and top portion 24, each portion having proximal and distal ends. Interior member 20 is of such a size and shape so as to be virtually unnoticeable to the wearer of the shoe. The surface of interior member 20 is smooth for the comfort of the wearer of the shoe.

In an embodiment, bottom portion 22 can be in the general form of a shoehorn with the distal end being rounded and wider than the proximal end. This configuration adds stability to the clasp and is slightly curved to match the inside face of the shoe shape, thus allowing it to fit snugly against the shoe as well as the wearer's foot.

Top portion 24 is congruent with proximal end of bottom portion 22. In some embodiments, top portion 22 extends upwardly from proximal end of bottom portion 22 to bifurcate into two elongate bodies 26 which are curved at their proximal ends to extend over the edge of the shoe. If used at the rear heel of a shoe, each elongate body 26 is positioned to be on either side of the middle seam on the heel of the shoe. In other embodiments, top portion 24 is construct having only one elongate body extending from proximal end of bottom portion 22.

In some embodiments, top portion 24 and bottom portion 22 are one solid piece forming interior member 20 while in other embodiments, top portion 24 and bottom portion 22 are separate but fixedly attached together to form interior member 20.

Exterior member 30 and attachment member 40 are shown as being curved to follow the natural curve of the shoe according to where clasp 10 is being positioned on the shoe, i.e. at the heel, toe, sides, etc. In use, the concave portion of exterior member 30 and attachment member 40 are positioned against the exterior face of the shoe with the curve following the curvature of the shoe. Exterior member 30 is shown as being in a half rectangular shape, however other shapes are contemplated as long as they are capable of housing hinge 60 for attachment to interior member 20. Similarly, attachment member 40 is shown as being triangular in shape, however other sizes or configurations are contemplated as long as they are capable of having a decorative ornament or other personalization attached thereto. Decorative ornament 70 can be either fixedly or removably attached to attachment member 40. In an embodiment, connecting bar 50 attaches exterior member 30 to attachment member 40. However, in other embodiments, exterior member 30 is directly attached to attachment member 40.

FIG. 2 depicts shoe clasp 10 in an open position. As depicted in the Figure, hinge 60 attaches interior member 20 to exterior member 30. In the embodiment shown, a pair of hinges are used, however in some embodiments, only one hinge is needed. Hinge 60 may be a double locking hinge which would allow locking of clasp 10 in two different positions. In other embodiments, hinge 60 may allow for locking in multiple positions. In some embodiments, a pair of hinges 60 connected by a bar are used to connect interior member 20 to exterior member 30. Locking of hinge 60 allows clasp 10 to clamp onto an edge of the shoe without causing damage to shoe.

Attachment member 40 is shown as having an aperture through the middle of its triangular shape. This aperture may be used for attachment of decorative ornament therethrough, however in some embodiments the aperture is not required.

Figure 3:
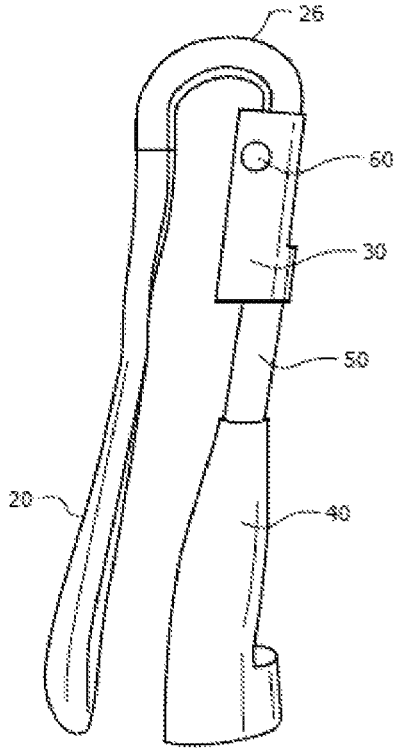
FIG. 3 is a side view of the shoe clasp.

FIG. 3 illustrates a side view of clasp 10 in a closed position. Curved elongate bodies 26 are shown attached to hinge 60 to attach interior member 20 to exterior member 30. Elongate bodies 26 can be in a tubular shape and curved at an angle to snugly fit around the edge of a shoe. Elongate bodies 26 may be in a flattened tubular shape in some embodiments to enhance comfort to the wearer. Connecting bar 50 is shown as attaching exterior member 30 to attachment member 40.

Figure 4:
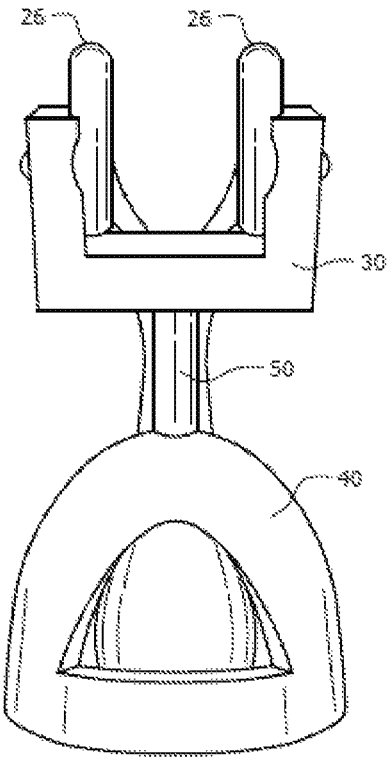
FIG. 4 is a back view of the shoe clasp.

FIG. 4 is a back view of clasp 10 depicting exterior member 30 and attachment member 40. As depicted in the Figure, elongate bodies 26 are positioned higher than exterior member 30 since they are needed to extend over the edge of the shoe. Connecting bar 50 is shown as attaching exterior member 30 to attachment member 40.

Figure 5:
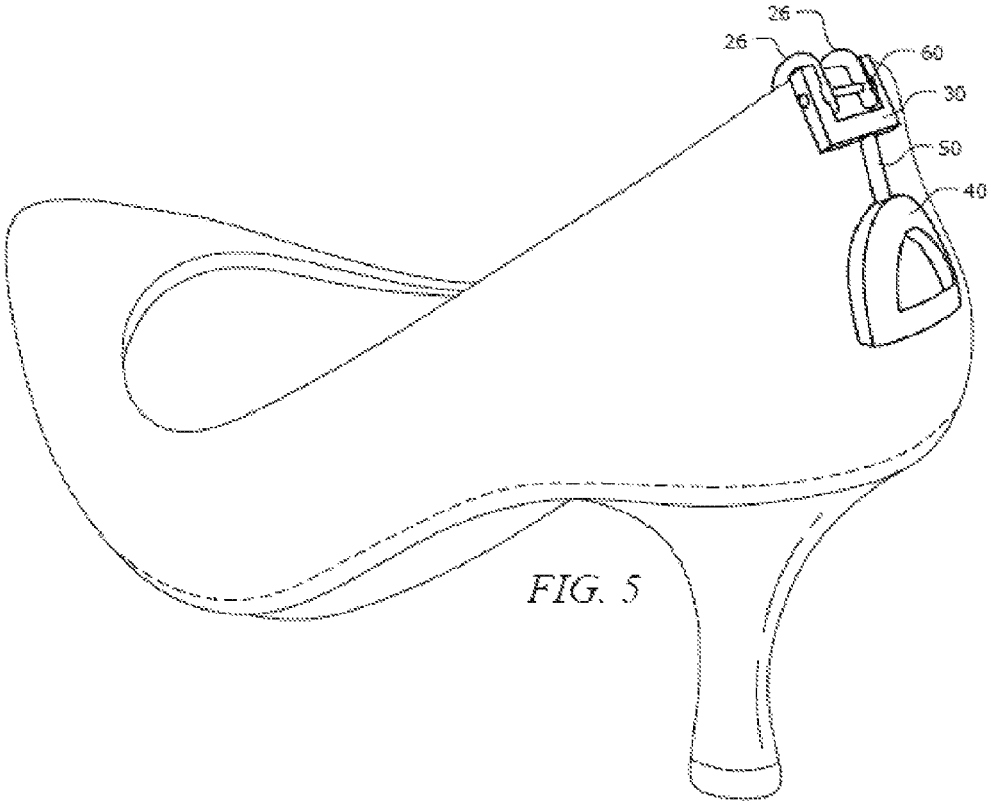
FIG. 5 is a perspective back view of the shoe clasp on a woman's high heel shoe.

FIG. 5 is an image depicting exterior member 30 and attachment member 40 of clasp 10 in one position on the rear of a shoe. As shown in the Figure, exterior member 30 and attachment member 40 are curved to sit flush against the exterior face of the shoe. Connecting bar 50 is shown as attaching exterior member 30 to attachment member 40. Elongate bodies 26 are shown wrapping around the edge of the shoe with hinge 60 locking into a closed position to secure clasp 10 to the shoe.

Figure 6:
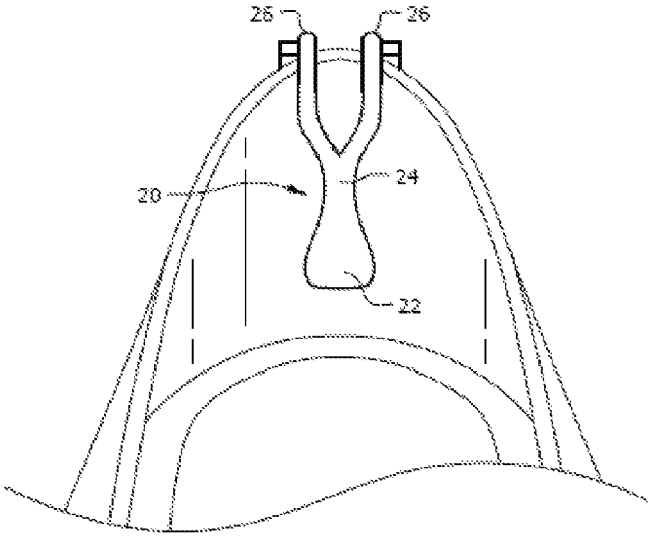
FIG. 6 is a front view of the shoe clasp on a woman's high heel shoe.

FIG. 6 is an image depicting positioning of clasp 10, and particularly interior member 20, against the interior face of the rear of a shoe. Interior member 20 is positioned to be flush against interior face of the shoe so as to be as unobtrusive as possible to the wearer of the shoe. Interior member 20 is shown as being formed of top portion 24 and bottom portion 22. Elongate bodies 26 are shown extending from the interior of the shoe over the edge of the shoe to connect to exterior member 30 on the outer face of the shoe.

Figure 7:
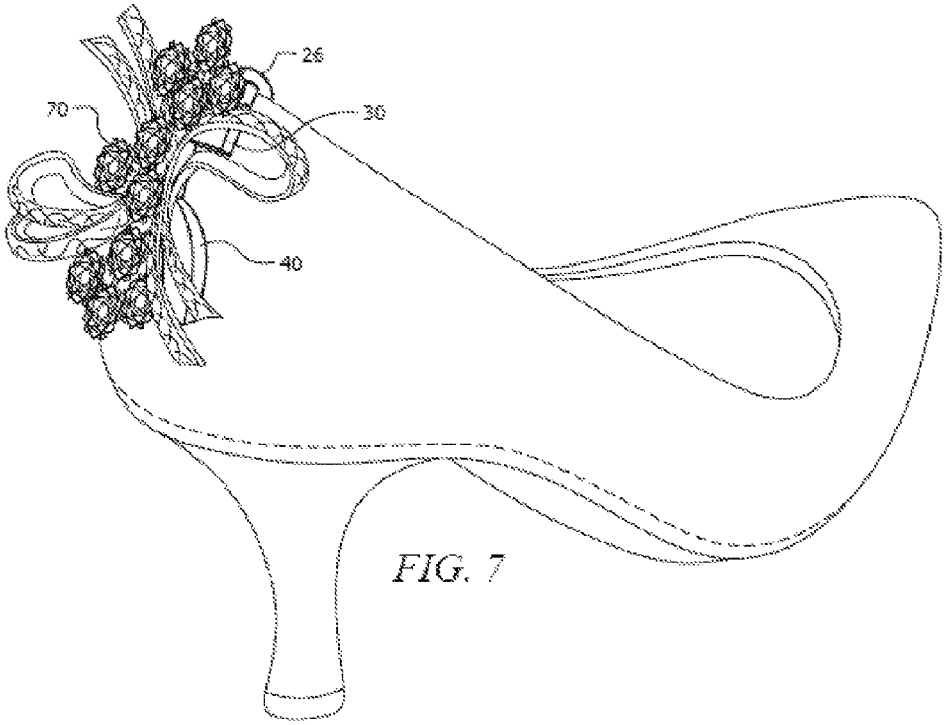
FIG. 7 is a perspective view of the shoe clasp holding an ornamental decoration on a woman's high heel shoe.

FIG. 7 is an image depicting decorative ornament 70 attached to attachment member 40 at the rear face of a shoe.

Figure 8:
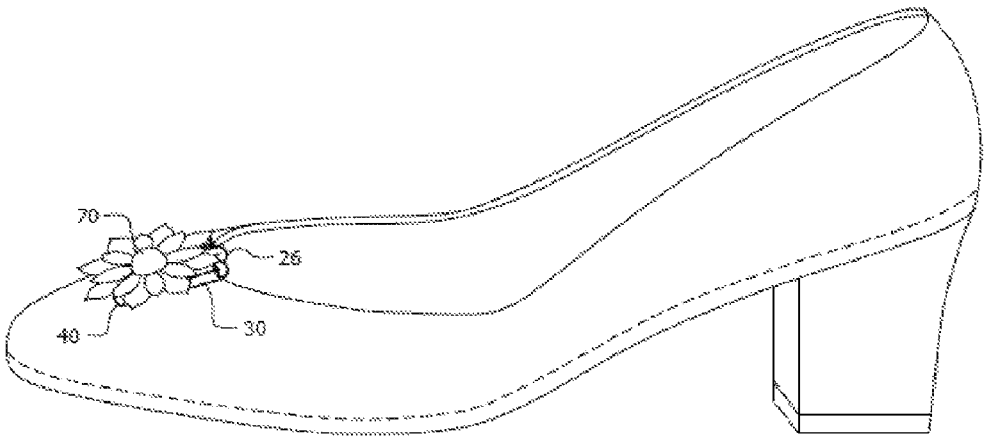
FIG. 8 is a perspective view of the shoe clasp holding an ornamental decoration on the toe portion of a woman's shoe.

FIG. 8 depicts decorative ornament 70 attached to attachment member 40 at the toe portion of a shoe.

In order to increase comfort to the wearer, the surface of interior member 20 may have a cushioning material attached to one or both sides. The cushioning material may include, but is not limited to, foam, rubber, neoprene or any other soft, slip-resistant material that is capable of being attached to interior member 20. Attachment of the cushioning material to the surface in contact with the wearer's skin increases comfort to the wearer while attachment of cushioning material to the surface of the side in contact with the shoe decreases any slippage that may be present. Cushioning material may also be added to the interior surface (surface that lies against the face of the shoe) of exterior member 30 and attachment member 40 in order to increase stability and provide protection from any potential damage to the shoe surface.

In an embodiment, the back surface (surface facing the interior shoe face) of interior member 20 may have a bar or spike extending laterally therefrom through the shoe. A locking member would then be placed on the spike to anchor clasp 10 to the shoe. This embodiment is particularly useful in shoes that already have an open area or hole such as sandals and sneakers with mesh.

Clasp 10 may be made in many different shapes and sizes according to the type of shoe as well as the potential placement of the clasp on the shoe. For example, clasps used on boots will be longer than those used on shoes. Clasps used at the heel of a shoe will likely be longer than those used at the toe portion of the shoe. Sizes may also differ according to the size and type of decorative ornament used.

In conclusion, the instant invention overcomes the deficiencies of the prior art and allows for a wearer to easily add decorative ornaments to their shoes in order to personalize their shoes. It also allows the wearer to move the clasp between different shoes and permits stable attachment to different parts of the shoe without causing any damage to the shoe.

In the preceding specification, all documents, acts, or information disclosed does not constitute an admission that the document, act, or information of any combination thereof was publicly available, known to the public, part of the general knowledge in the art, or was known to be relevant to solve any problem at the time of priority.

The disclosures of all publications cited above are expressly incorporated herein by reference, each in its entirety, to the same extent as if each were incorporated by reference individually.

It will thus be seen that the objects set forth above, and those made apparent from the foregoing disclosure, are efficiently attained. Since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein disclosed, and all statements of the scope of the invention that, as a matter of language, might be said to fall therebetween. Now that the invention has been described,

What is claimed is:

1. A removable apparatus for attaching a decorative ornament to a shoe comprising:

an interior member having proximal and distal ends wherein the distal end is wider than the proximal end;

a concave substantially inflexible exterior member having first and second ends and hingedly attached to the interior member at the first end by at least one hinge wherein the exterior member substantially mates with a convex exterior surface of the shoe; and a concave substantially inflexible attachment member fixedly attached to the second end of the exterior member wherein the attachment member substantially mates with a convex exterior surface of the shoe;

wherein the proximal end of the interior member is positioned over an edge of the shoe allowing the interior member to sit flush with an interior surface of the shoe and the exterior member to sit flush with an exterior surface of the shoe.

2. The apparatus of claim 1, further comprising a connecting bar positioned between the second end of the exterior member and the attachment member to connect the exterior member to the attachment member.

3. The apparatus of claim 1, further comprising a decorative ornament attached to the attachment member.

4. The apparatus of claim 3, wherein the decorative ornament is fixedly attached.

5. The apparatus of claim 3, wherein the decorative ornament is removably attached.

6. The apparatus of claim 1, wherein the interior member is comprised of a bottom portion and a top portion.

7. The apparatus of claim 6, wherein the bottom portion of the interior member is in the shape of a shoehorn.

8. The apparatus of claim 7, wherein the top portion of the interior member is comprised of at least two elongate bodies.

9. The apparatus of claim 1, wherein the interior member is curved to follow a curve of an interior surface of the shoe.

10. The apparatus of claim 1, wherein the at least one hinge is a double locking hinge.

11. The apparatus of claim 1, wherein the distal end of the interior member is rounded.

12. The apparatus of claim 1, wherein a non-slip cushioning material is attached to at least one surface of the interior member.

13. The apparatus of claim 1, wherein a non-slip cushioning material is attached to an interior surface of the exterior member and the attachment member.

14. A removable apparatus for attaching a decorative ornament to a shoe comprising:

an interior member comprising:

a top portion having a proximal and a distal end wherein the proximal end of the top portion is comprised of two curved elongate bodies;

a bottom portion having a proximal and a distal end wherein the distal end of the bottom portion is wider than the proximal end of the bottom portion;

a concave substantially inflexible exterior member having first and second ends and hingedly attached to the interior member at the first end by at least one hinge wherein the exterior member substantially mates with a convex exterior surface of the shoe; and a concave substantially inflexible attachment member fixedly attached to the second end of the exterior member wherein the attachment member substantially mates with a convex exterior surface of the shoe;

wherein the two elongate bodies of the interior member are positioned over an edge of the shoe allowing the interior member to sit flush with an interior surface of the shoe and the exterior member to sit flush with an exterior surface of the shoe.

15. The apparatus of claim 14, further comprising a decorative ornament attached to the attachment member.

16. The apparatus of claim 14, further comprising a connecting bar positioned between the second end of the exterior member and the attachment member to connect the exterior member to the attachment member.

17. The apparatus of claim 14, wherein the distal end of the bottom portion of the interior member is rounded.

18. The apparatus of claim 14, wherein the pair of hinges are double locking hinges.

19. The apparatus of claim 14, wherein a non-slip cushioning material is attached to at least one surface of the interior member.

20. The apparatus of claim 14, wherein a non-slip cushioning material is attached to an interior surface of the exterior member and the attachment member.

* * * * *